US005150557A

United States Patent [19]

Gregory

[11] Patent Number: 5,150,557

[45] Date of Patent: Sep. 29, 1992

[54] ADJUSTABLE SHORING SYSTEM

[76] Inventor: Robert K. Gregory, 1110 Eikel, Ste. C, New Braunfels, Tex. 78130

[21] Appl. No.: 629,116

[22] Filed: Dec. 17, 1990

[51] Int. Cl.[5] ..... E04H 12/00

[52] U.S. Cl. ..... 52/646; 248/354.3; 248/352; 248/688

[58] Field of Search ..... 52/646, 648; 248/688, 248/352, 354.3

[56] References Cited

FOREIGN PATENT DOCUMENTS 0088503 12/1956 Norway ..... 248/354.3

*Primary Examiner*—David A. Scherbel
*Assistant Examiner*—Wynn E. Wood

[57] ABSTRACT

A handset shoring system for supporting elevated concrete slabs and beams which can readily be integrated into other systems but has benefits of lightweight strength, field adaptability, and an infinitely variable range of sizes for optimum usage. Laminated veneer lumber posts with force-fit steel end cap provide the shoring legs having screw jack and U-heads thereon. An adjustable beam form can also be mounted atop the shoring system.

13 Claims, 6 Drawing Sheets

ADJUSTABLE SHORING SYSTEM

FIELD OF THE INVENTION

The present invention relates to hand-set shoring systems employed in the building construction field of art for supporting elevated slab and beam forms. More particularly, the invention relates to an improved adjustable shoring system and components thereof which are strong yet light weight and which are readily adapted for varied shoring requirements or for interface with other shoring systems.

BACKGROUND OF THE INVENTION

In the field of building construction, a great variety of shoring systems are utilized to facilitate the forming of concrete slabs, beams and other structures. One of the most common implements used in the on-site formation of concrete slabs and beams are hand-set shoring systems. Erecting and dissembling such hand-set shoring systems is a significant part of the normal building construction process whenever elevated concrete slabs or beams are poured on-site. It is therefore desirable to provide an inexpensive shoring system which is readily erected to support such form work in varying job applications, and which is then easily broken down and moved to the next pour site. The size, weight and complexity of a shoring system are all factors which affect the ease with which it is implemented, whereas such factors must be balanced with its strength and durability.

The material of a shoring system is central to most of these considerations. In the past, lumber has been a particularly popular material largely because it tends to be relatively lightweight and inexpensive. Timber supports are also more adaptable than metal supports in the sense that a timber plank can be readily cut, bored or nailed as the particular needs may change from one pour site to the next.

However, the strength and durability of timber supports can be somewhat limiting on their utility, and for that reason many resort to more costly metal supports. Strength and durability are particularly critical for shoring tower legs, which are generally required to carry the substantial majority of the load in a shoring system. Shoring tower legs must also be equipped to interface with the rest of the shoring system. For instance, each leg is typically provided with a screw jack or the like at one or both of its ends to enable adjustment of its length. Couplings, U-heads, and other shoring connections may also be provided at the ends. Because the shoring connections of different systems may have connecting shanks of differing diameters, it is advantageous that a shore leg would be adaptable to receive shanks of differing sizes at the ends thereof.

Because shoring tower legs (or "shore legs") carry principally an axially compressive load, the main structural concern for shoring towers is buckling. The height, diameter, and composition of the leg, factored in relation to the load which it is to carry, are principal determiners in considering its resistance to buckling. The likelihood of buckling is further increased if the load is off-center ("eccentric"). Cross braces and other supports are often used to minimize the risk of buckling. Timber shore legs present several problems in this area because they are more susceptible to splitting than many other materials. The risk of splitting is further increased by the mounting of shoring connections such as screw jacks or braces which tend to create stress concentration where they are mounted to the shore leg.

Laminated veneer lumber ("LVL"), which is essentially lumber formed of thin layers of wood laminated together as a composite, provides an alternative material that is becoming quite popular in the area of formwork supports in general. Some of the benefits of such LVL are that it is straighter and truer than ordinary lumber, it has nearly perfect concentricity of load, and its composite nature enhances its strength while minimizing the weaknesses of flaws in the individual layers. Despite such benefits, though, LVL members are principally used only as secondary supports, such as braces, ledgers or the like when implemented in hand-set shoring systems. One of the problems with using LVL as shoring tower leg material is that, when boring the necessary end bores for mounting screw jacks, U-heads or other connectors in such a solid, strong, and dense material, the drill bit tends to wander off course. The result is a canted end bore which induces what is known as a "dog leg" in the shore, causing bending and reducing its load capacity. Concentric alignment of end bores may be partially ensured with better boring equipment, but the use of such equipment is infeasible at most jobsites. Pre-drilled end bores are a conceivable alternative but their utility is lost when the post is cut to size, thereby eliminating the pre-bored end and defeating its purpose.

Previous products in the field of shoring systems present many examples of the required compromises and limitations accompanying metal shoring. For instance, Cunningham Manufacturing and Formwork Engineering Corp. both have steel beam form systems supported by 5' wide welded steel frames that are load limited and limited to 5' wide × 10' long towers due to the weight of the steel and the welded structure. The tubular leg naturally accepts the screw jacks and U-heads, but only in a given diameter. The steel cross bracing of those systems is similarly set for several fixed length braces such as 10' that fit 4'-0" stud spacing welded to the legs, with little adaptability of size. Consequently, the shoring towers in such systems cannot fit in certain kinds of structures or under ramps, and the steel beam forms have a limited adjustment range. One of their few advantages is provided by a folding tower which facilitates movement of the system from one pour site to the next.

Other manufacturers supply steel shoring frames somewhat like those described above, with the principal difference being the manner in which braces are attached to the frames. Relatively light-weight aluminum shoring frames are known, although they are not known to be adjustable on-site in width or height, nor are they readily interfaced with other systems, nor do they employ foldable towers.

It is therefore an object of the present invention to enable achievement of high strength with light-weight materials while minimizing the likelihood of buckling in shoring tower legs. Another object of the present invention is to provide a shoring system which utilizes LVL shore legs which can be field cut and provided with virtually concentric end-bores for receiving screw-jacks and other shoring connections therein, thereby ensuring that bending stresses and the risk of premature buckling are minimized.

Many other objects will be obvious from the following summary and description of the invention, particularly when viewed in conjunction with the accompanied drawings and in light of the appended claims.

SUMMARY OF THE INVENTION

The present invention addresses the foregoing objects and others by providing an improved hand-set shoring system which is readily adaptable and adjustable in the field while retaining load capacity in order to accommodate a much wider range of sizes and load requirements for optimum usage. The invention is multifaceted and is readily used, co-mingled, or integrated with other shoring systems.

One of the key features of the invention is an improved shoring leg which comprises a post having a longitudinally-oriented central pilot hole therethrough to enable the drilling of end bores in the post for mounting shoring connectors therein. End caps which fit snuggly on each end of the post are also provided to induce triaxial compression in the end regions of the post and to provide bearings for the shoring connectors. The shoring post of the invention is a timber post, ideally laminated veneer lumber, which can be cut to a desired length for its intended use in order to optimize material usage, costs and load capacity. To ensure that the longitudinally-oriented pilot hole of the post is centrally aligned, the post is formed from mating members having a groove dadoed therein and then laminated together in a manner such that the groove defines the central pilot hole. Ideally, a screw jack is the shoring connector mounted in the lower end bore of the post, and a U-head is the shoring connector mounted in the upper end bore of the post. The end caps have central holes therethrough for allowing reception of the shank of such connectors, and the end bores of the posts are drilled to match the outside diameter of those shanks. A taper, either in the interior surface of the end caps or on the exterior surface of the ends of the post, is provided to enhance the triaxial compression of the post ends such that, when the post is axially loaded, the triaxial compression increases.

Four such posts are integrated in a shoring tower with adjustable Z-frames and cross-bracing joining the separate legs of the post in a manner such that the shoring tower can be readily adapted to varying requirements and optimum configuration. An adjustable bracing collar slidably engaged with each post in a sleeve-like manner further facilitates such adaptability. A plurality of threaded nuts and studs are welded to the outer surfaces of the end cap and bracing collar sidewalls to facilitate mounting of such braces thereto. A header caps off each side of the shoring tower which may support both a slab form and an adjustable beam form. To enable handling of the shoring tower, the legs of each end frame may be hinged to the headers thereof, with the adjustable beam form tied thereto so that the combination of the shoring tower and beam form can be readily stripped from a curing beam for transporting to the next poor site, leaving the slab form to follow behind at a later point.

Many other objects, features and advantages will be apparent to those of ordinary skill in the art, particularly in view of the following more detailed description of certain preferred embodiments of the invention.

BRIEF DESCRIPTION OF THE DRAWINGS

The following more detailed description of preferred embodiments should be considered in conjunction with the attached drawings wherein like numbers refer to like parts throughout, and wherein.

DETAILED DESCRIPTION OF PREFERRED EMBODIMENT

Figure 1:
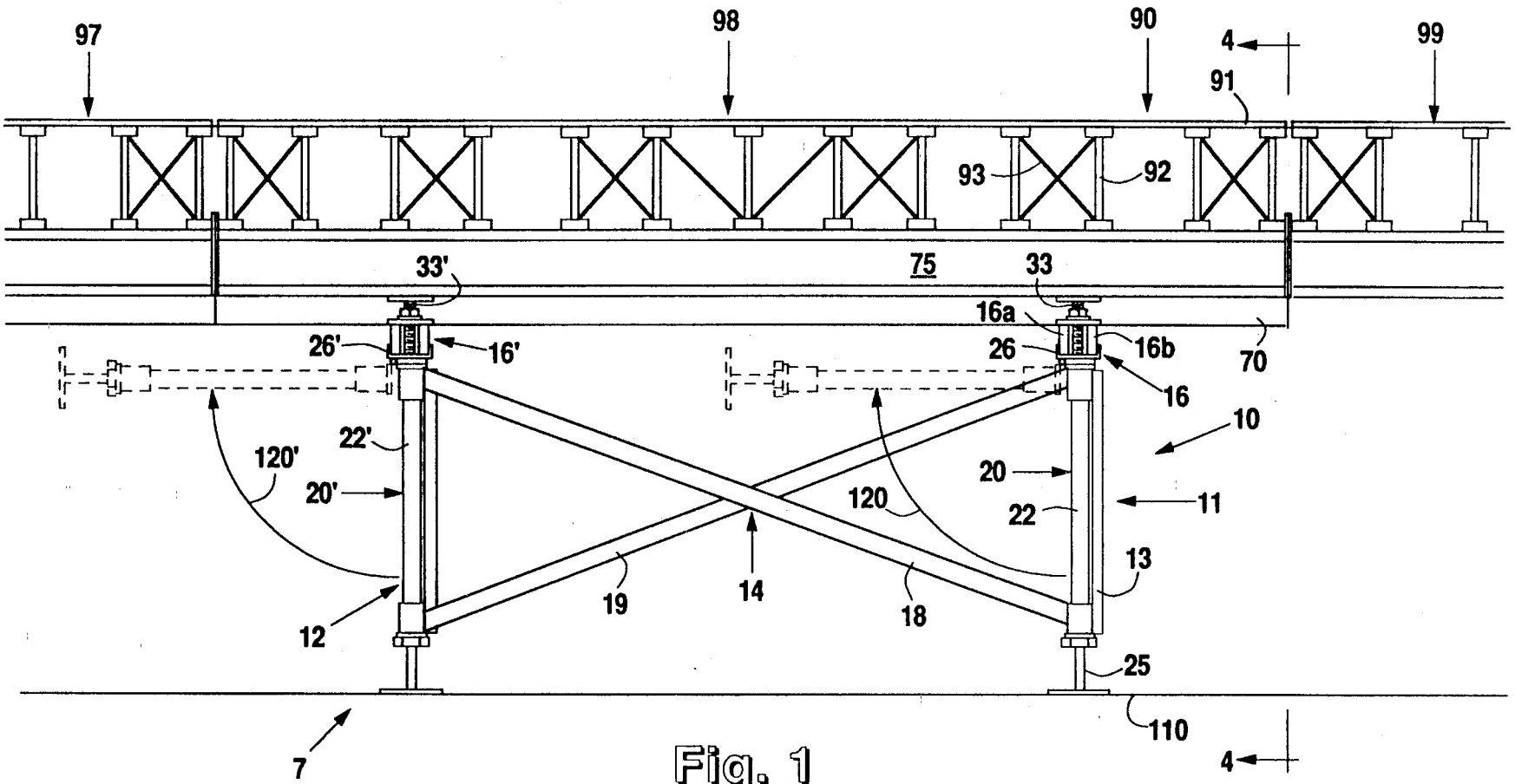
FIG. 1 shows an elevation view of a hand-set shoring system 7 according to the teachings of the present invention, with the system 7 shown in a typical employment for supporting deck form 90 at a pour site.

Referring to FIG. 1, there is shown a hand-set shoring system 7 constructed in accordance with the teachings of the present invention. The shoring system 7 basically comprises a shoring tower 10 and a pair of stringers 75 and 75' supported thereon (75' shown in FIG. 7). Shoring tower 10 (shown generally in FIG. 4) includes shore frames 11 and 12 positioned parallel and opposite one another. The shore frames 11 and 12 are linked together by removable cross-bracing 14 and 14'. Stringers 75 and 75' are supported atop shore frames 11 and 12, directly on grading jacks 33, 33', 34 and 34'. In use, stringers 75 and 75' are oriented approximately perpendicular to the joists 92 of deck form 90, and shoring system 7 supports the deck form 90 in a pour position atop stringers 75 and 75'. The high load capacity of legs 20, 20', 21 and 21' enables headers 16 and 16' to support the weight of both slab 100 and beam 101.

Figure 4:
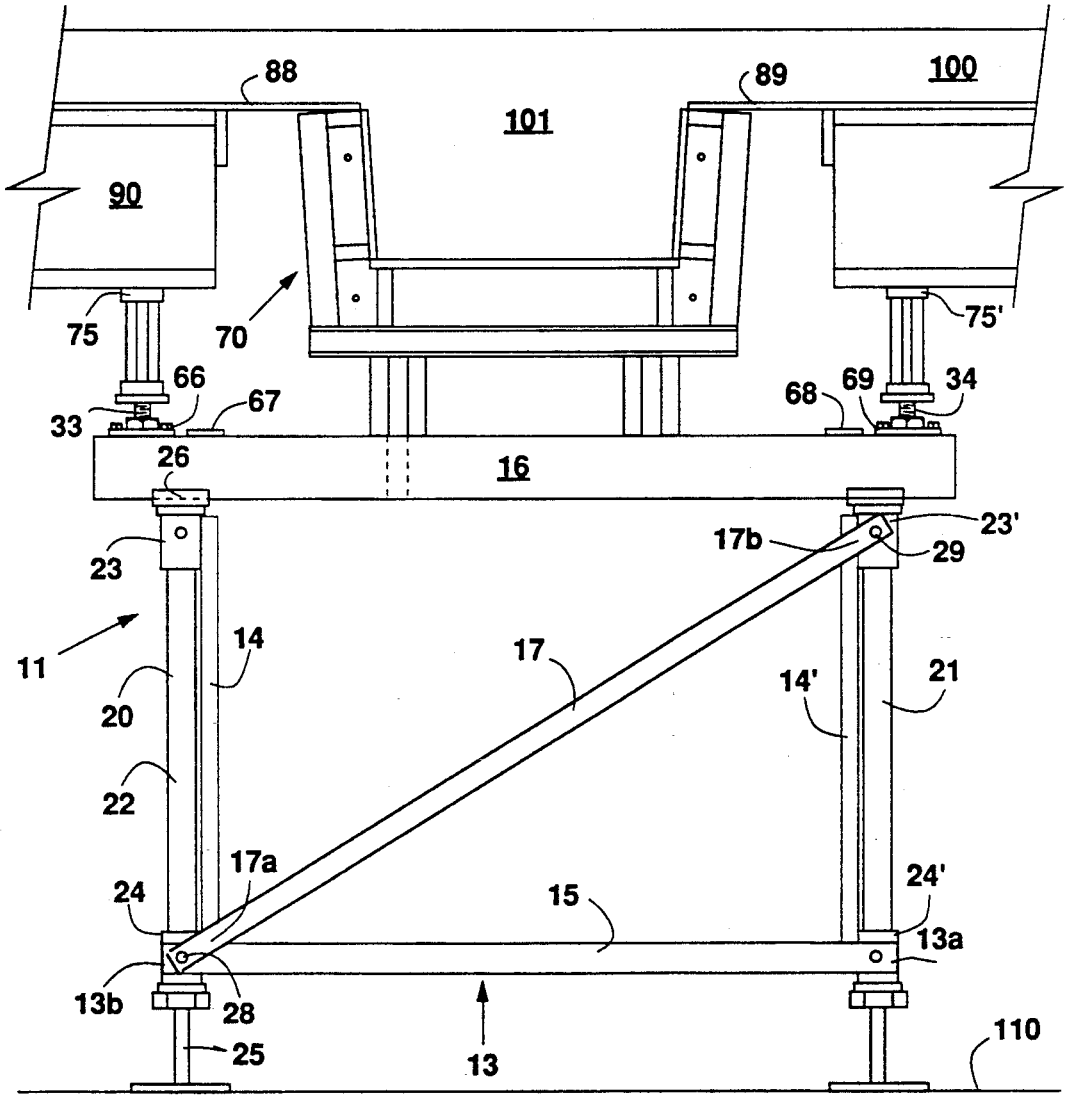
FIG. 4 shows an end-on elevation view of the hand-set shoring system 7 as viewed from sectional plane 4—4 of FIG. 1.
Figure 7:
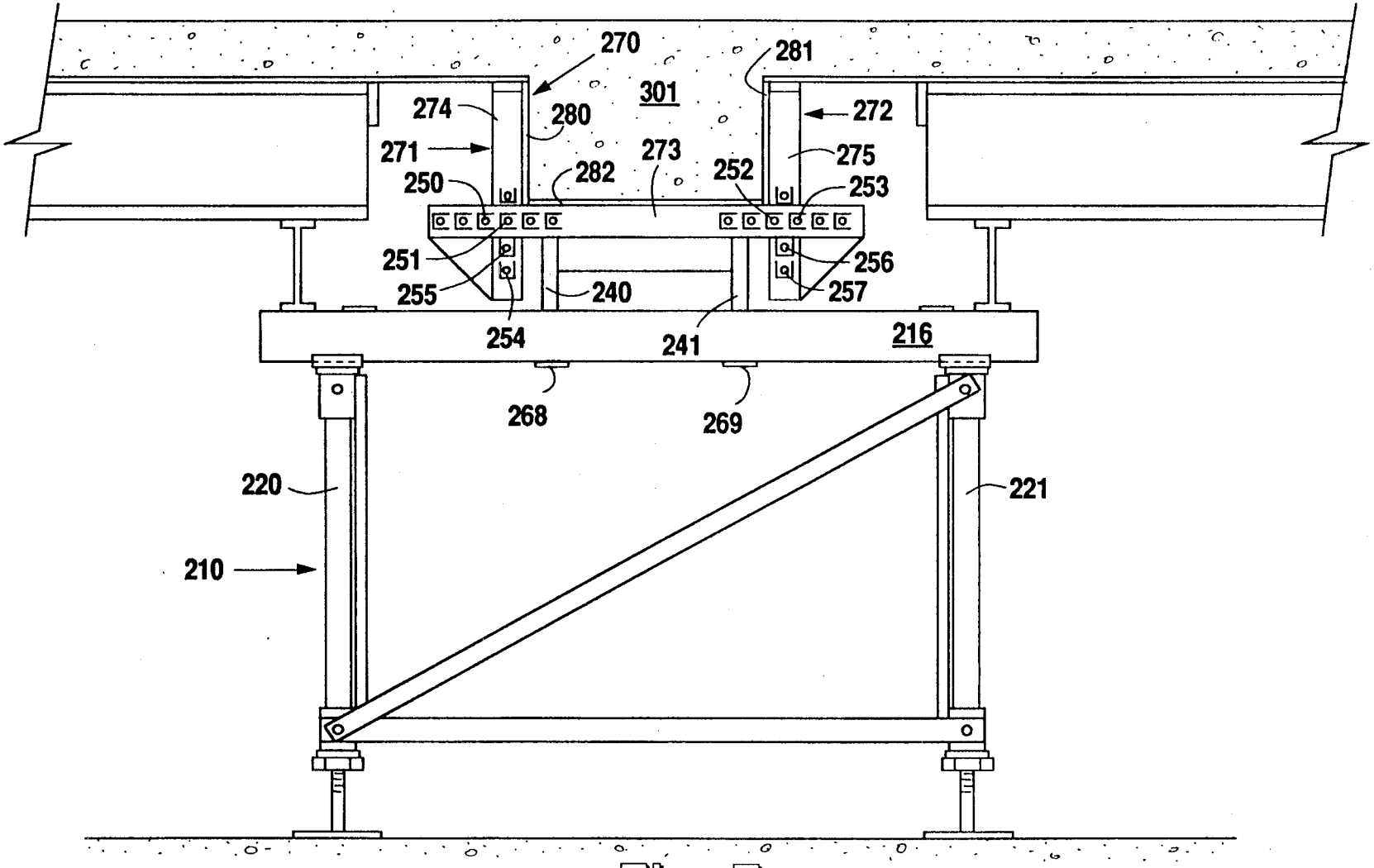
FIG. 7 shows an end-on elevation view of a second hand-set shoring system 207 embodying the invention, including an adjustable beam form 270 mounted shoring towers 210.

The deck form 90 is of the conventional type comprising joists 92 and plyform 91, on which a concrete slab will be poured and formed. Deck form 90 is separable as tables 97–99, each having 16 foot length (length being the dimension visible in FIG. 1). The joists 92 of deck form 90 are parallel and conventionally spaced beneath plyform 91. Joists 92 are rigidly secured to plyform 91 with conventional means, and bridging 93 is employed to ensure the structural integrity of platform 91. The preferred embodiment of shoring system 7 in combination with deck form 90 is designed to support the concrete slab 100 having concrete beams 101, as shown in FIG. 7. The beams 101 are typically 15–18 inches wide and 24–36 inches deep, as shown in FIG. 4. To facilitate formation of beam 101, the preferred embodiment is also provided with beam form units 70, as shown in FIG. 4 and as will be further described herein. Conventional closure panels 88 and 89 are employed to bridge the gap between deck form 90 and beam form 70.

Referring to FIG. 4, shore frame 11, which is structurally similar to shore frame 12, is shown from a direction perpendicular to that of FIG. 1. Shore frame 11 basically comprises two shoring legs 20 and 21 joined by Z-frame 13. Grading jacks 33 and 34 are supported by the header (or "cross support") 16. Header 16, which is the upper member of Z-frame 13, is actually composed of two horizontal members 16*a* and 16*b* (shown in FIGS. 1 and 3) which are anchored to U-heads or legs 20 and 21 by means of conventional tie-downs 66–69. The load capacity of each shoring frame 11 and 12 in the preferred embodiment with selected LVL has been found to be approximately 18,000 pounds if braced at 4'–6" c/c, 15,000 pounds if braced at 5'0" c/c, 12,000 pounds if braced at 5'6" c/c, and/or 11,000 pounds if braced at 6'0" c/c; however, this depends on leg composition.

Figure 3:
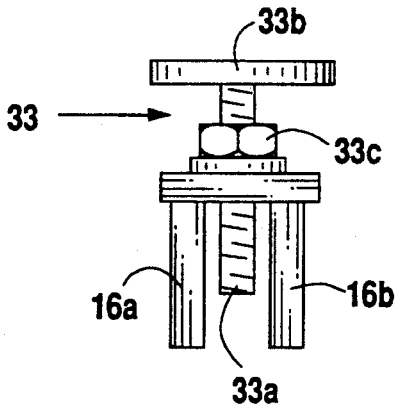
FIG. 3 shows a detail elevation view of the header 16 and the grading jack 33 of the shoring system 7 shown in FIG. 1.

Referring to FIG. 3, grading jack 33 (similar to grading jacks 33', 34 and 34') is a screw jack provided with a support plate 33*b* for engaging and supporting stringer 75. Jack 33 is also provided with a threaded shank 33*a* (extending perpendicular from plate 33*b*) threadably engaged with a threaded nut 33*c*. Threaded nut 33*c* rests on header members 16*a* and 16*b*, with washers 33*d* therebetween, and shank 33*a* extends between members 16*a* and 16*b*. As will be evident from the second embodiment, though, grading jacks 33 and 34 are not essential for every application.

Figure 6:
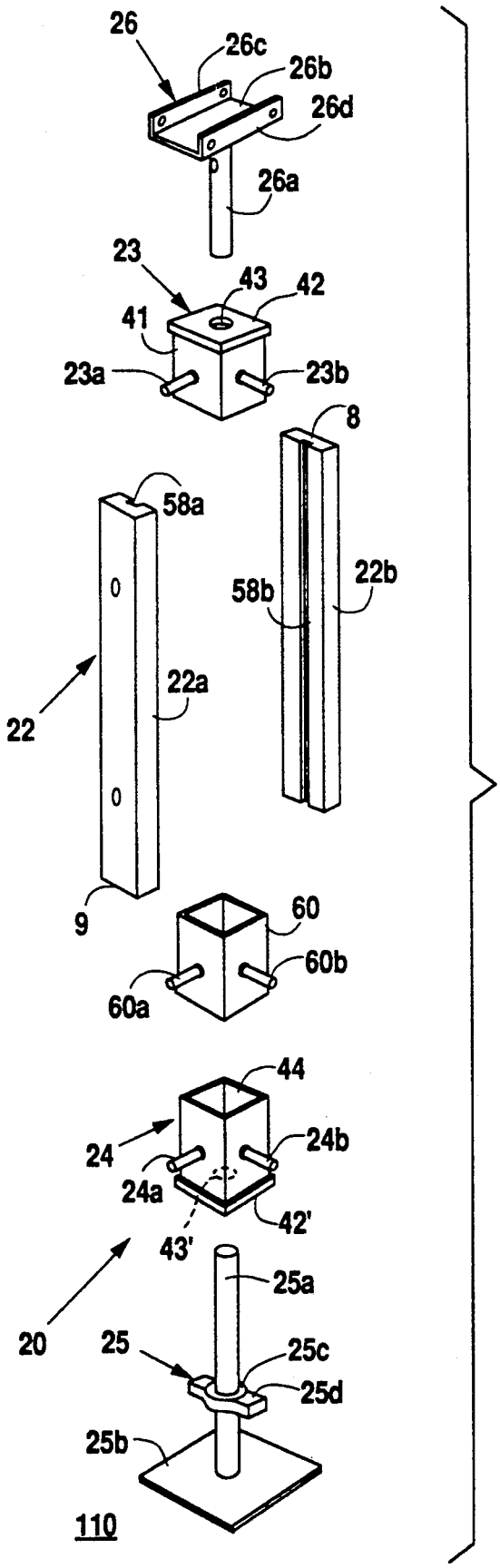
FIG. 6 shows an exploded perspective view of shoring tower leg 20 of shoring system 7.

Each of shoring legs 20 and 21 are substantially identical in the preferred embodiment, although their similarity is not critical to the invention. With reference to shoring leg 20, as best shown in FIG. 6, each shoring leg itself includes a post 22, end caps 23 and 24, a base jack 25 and a U-head support 26. Collar 60, the position of which is adjustable along the height of post 22 between end caps 23 and 24, may also be provided to facilitate the implementation of auxiliary bracing (not shown). As will be evident to those of ordinary skill in the art, though, the shoring legs 20 and 21 or even the subcomponents thereof (such as post 22) may be integrated with other types or makes of hand-set shoring system with little or no adapting required, even with job-built shoring systems by using 4-by-4's and 2-by-4 braces nailed thereon.

The post 22 of leg 20 is a typically 4-by-4 post which may be cut to any length to optimize the stringers and leg spacings of the shoring system 7. Initially, though, each post 22 is approximately six feet long. Other types of timber or other composites could also be used to appreciate certain aspects of the invention, although LVL provides great advantages when combined with the end caps and other elements described herein.

To enable concentric boring of post 22 at its ends 8 or 9, a pilot hole 58 is first introduced along the centerline of the post 22. Referring to FIG. 7, post 22 is actually formed of two 2-by-4 LVL members 22*a* and 22*b*. Before reaching the job site, each of members 22*a* and 22*b* are routed with a quarter-inch (¼") by one-half inch (½") dado (58*a* and 58*b*, respectively). Dadoes 58*a* and 58*b* are routed along the entire length of the longitudinal centerline of one of the broader surfaces of each of members 22*a* and 22*b*. The dadoed surfaces of members 22*a* and 22*b* are then mated together and laminated to form post 22. The result of that process provides a longitudinally-oriented central pilot hole 58 (formed by the union of dadoes 58*a* and 58*b*) through the entire length of post 22. Thus, either of the exposed ends 8 or 9 of post 22 can be readily bored with a concentric bore for receiving the shank of a screw jack, coupler, U-head, or any other shoring connector as may be required in the course of use. In the process of boring such a hole at the exposed ends 8 or 9 of the post 22, pilot hole 58 serves to guide the drill bit and prevent it from wandering, thereby ensuring a centrally aligned bore for receiving the connecting shank. Moreover, if post 22 is cut to optimize its utility for varying requirements at a job site, the pilot hole 58 is always revealed at the exposed ends 8 or 9 of the post 22 to ensure centrally aligned drilling despite the cut. Although referred to as "exposed ends" herein, during use each opposite end 8 and 9 of post 22 is capped by an end cap— upper end cap 23 and lower end cap 24, respectively. Referring to FIG. 6, each end cap 23 and 24 is of similar construction, although end cap 23 is obviously oriented differently than end cap 24 in order to enable reception of ends 8 and 9, respectively, therein. As will be discussed further herein, end caps 23 and 24 are also positioned to enable mounting of Z-frame 13 and cross-bracing 14 on anchor bolts 23*a*, 23*b*, 24*a* and 24*b* extending from end caps 23 and 24, respectively. Each end cap 23, 24 provides a box-like enclosure formed of orthagonal sidewalls 41 and an end plate 42 welded to each of the sidewalls 41. Central hole 43 is provided in the center of end plate 42 for allowing insertion of shoring connector shanks therethrough. For instance, hole 43 of end cap 23 allows passage of the shank 26*a* of U-head 26 therethrough, and hole 43' of end cap 24 allows passage of shank 25*a* of base jack 25 therethrough. End plates 42 and 42' also provide bearing surfaces for screw jacks, couplers, or U-heads, depending on which particular connection is mounted thereto (namely U-head 26 and screw jack 25 in the preferred embodiments).

End caps 23 and 24 are sized and shaped to be force-fit onto the respective ends 8 and 9 of post 22, thereby compressing those ends 8 and 9 both axially and from each side. In the preferred embodiment, the interior surface of end caps 23 and 24 taper slightly toward their respective end plates 42 and 42'. More particularly, referring to lower end cap 24, the open face 44 of end cap 24 is sized only slightly larger than end 9 of post 22 to provide a snug fit, while the cross-sectional area of the socket 56 formed by end cap 24 reduces toward end plate 42' at which the cross-sectional area of socket 56 is significantly smaller than the cross-sectional area of the lower end 9 of post 22. Thus, the end 9 of post 22 is compressed gradually as end cap 24 is forced further thereon.

When assembled for use, the ends 8 and 9 of post 22 completely fill the sockets 56 and 56' which are formed by end caps 23 and 24, respectively. Ends 8 and 9, thus, abut end plates 42 and 42', respectively within sockets 56 and 56'. The above-described process of mounting end caps 23 and 24 on post 22 induces triaxial compression in post 22 in the regions of ends 8 and 9, even prior to loading leg 20. Such triaxial compression serves to reduce the likelihood of post 22 splitting while moving laterally under load, in part due to the fact that transverse tension will not occur in any direction within post 22 without first overcoming (or exceeding) the triaxial compression induced by end caps 23 and 24. Thus, such triaxial compression enables higher bearing capacity of leg 20.

As an alternative (not shown) to the tapered end cap, while still achieving some of the same and similar objects of the invention, the exposed ends 8 and 9 of post 22 are shaved equally on all four sides to provide a slight taper on each side of the post itself rather than in the end caps 23 and 24. By providing such a taper, either in the intersurface of end caps 23 and 24 (as preferred) or on the side surfaces of ends 8 and 9 (the above alternatives), axial loads on leg 20, which are normally encountered in use, increase the triaxial compression induced by end caps 23 and 24. Specifically, as such axial loads on leg 20 increase, axial strain in the ends 8 and 9 of post 22 force the side of ends 8 and 9 evermore tightly with end cap 23 and 24, thereby further increasing the triaxial compression of ends 8 and 9. Whether the taper is machined in the wood, in the cap, or molded thereon, the triaxial compression is similar.

As mentioned, anchor bolts 23*a*, 23*b*, 24*a* and 24*b* extend from adjoining sidewalls (41 and 41', respectively) of each end cap (23 and 24, respectively). Although not shown in the drawings, the other two sidewalls of each end cap (23 and 24) are provided with threaded nuts welded on the outer surface thereof for threadably receiving bolts (not shown) therein. The thread axis of each of such nuts and anchor bolts 23*a*, 23*b*, 24*a* and 24*b* are radially oriented relative to the central axis of leg 20. The anchor studs (23*a*, 23*b*, 24*a* and 24*b*) are welded to their respective sidewalls of end caps 23 and 24 and are sized for mounting conventional cross-bracing 14 and 14' thereon. The welded nuts (not shown) on the opposite sidewalls of end caps 23 and 24 are provided for enabling connection of the members of Z-frame 13 thereto, in a conventional manner. Cross-bracing 14 and 14' on each side of shoring tower 10 are formed of diagonal members 18 and 19 and diagonal members 18' and 19', respectively. In the preferred embodiment, braces 18, 18', 19 and 19' are each spanked tubing, although standard angle braces or other conventional cross-bracing materials may also be used.

The central holes 43 and 43' in the end plates 42 and 42' further facilitate alignment of such screw jacks, couplers, or U-head concentric with the post 22 in order to ensure concentric loading and alignment of screw jack, U-head or other shoring connections which may be mounted at the exposed end.

Figure 2:
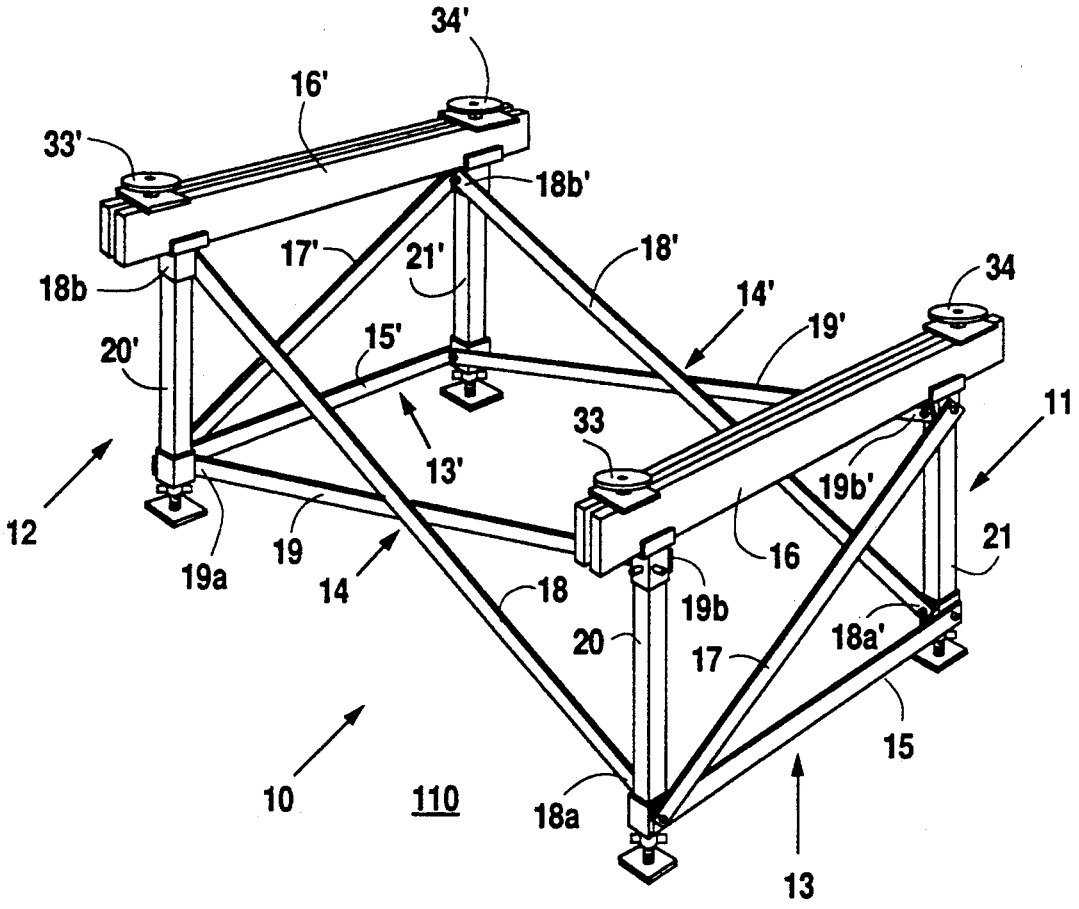
FIG. 2 shows a bird's-eye perspective view of shoring tower 10 of the hand-set shoring system 7 shown in FIG. 1.

Z-frame 13, which is similar to the opposite Z-frame 13', comprises three members: lower horizontal brace 15, diagonal brace 17 and header 16. The lower horizontal brace 15 is preferably an LVL composite, but the diagonal brace 17 in the preferred embodiment is a brace formed of spanked metal tubing or standard angle members. Each of the bracing members 15 and 17–19 are straight members having holes at their opposite ends for connection to the appropriate end cap. For instance, horizontal brace 13 is connected at one end 13*a* to the lower end cap 24' of leg 21, and the opposite end 13*b* of horizontal brace 13 is connected to lower end cap 24 of leg 20. The lower end 17*a* of diagonal brace 17 is also connected to lower end cap 24, while the upper end 17*b* of diagonal brace 17 is connected to upper end cap 23' of leg 21. Cross-braces 14 and 14', which comprise first diagonal member 18 and 18' and second member 19 and 19' (numbered in FIG. 2) are likewise connected to opposite upper and lower end caps of legs 20 and 20' and 21 and 21'. Nuts and bolts or other conventional means which are not shown in detail are required to complete the connections of braces 15 and 17–19 to the respective end caps of legs 20, 20', 21 and 21'. Second Z-frame 13' is similar to Z-frame 13 and is incorporated in shore frame 12 in basically the same manner that Z-frame 13 is incorporated in shore frame 11. Likewise, side bracing 14' is mounted to and between shore frames 11 and 12 on the side opposite cross-bracing 14.

The adjustable bracing collar 60 is similar in construction to end caps 23 and 24 except that collar 60 has no end plate and is not tapered. Adjustable bracing collar 60 is also provided with a slightly larger, uniform cross-section so that it can be readily moved from the upper end 8 to the lower end 9 of post 22. Adjustable bracing collar 60 also includes conventional means for clamping anywhere along the post 22 in order to develop the load required. Adjustable bracing collar 60 also has threaded nuts and threaded studs 60*a* and 60*b* welded to the outer surfaces of its sidewalls, just as with end cap 23 and 24. With such threaded nuts and studs 60*a* and 60*b* enabling the connection of braces at essentially any location along the length of post 22, the use of such bracing (and the shoring tower 10 in general) can be optimized. For instance, with implementation of tower 60, auxilary braces (i.e. in addition to those braces shown in FIG. 2) can be added to further reinforce shoring tower 10. As another example, when lighter deck forms are used or when lower ceilings are encountered, such as with parking structures, the legs 20, 20', 21 and 21' of tower 10 can be spaced wider. Such an adjustment in the spacing of legs 20, 20', 21 and 21' can be readily achieved with shoring tower 10 by implementing adjustable collars 60 on each of such legs 20, 20', 21 and 21' such that, for instance, the lower ends 18*a*, 18*a'*, 19*a* and 19*a'* of cross-braces 14 and 14' can be adjusted upwardly and connected to the respective posts as a higher point, thereby providing greater separation between shore frames 11 and 12 without requiring replacement of cross-bracing 14 and 14'. Such an adjustment is particularly advantageous because wider spacing of the legs 20, 20', 21 and 21' beneath the beam forms shortens the required span of deck joist 92 and gives an overhang condition to those joists 92. Consequently, the required size and quantity of the deck joist 92 is reduced by as much as 30%, which means appreciable savings in construction costs. Adjustment of collar 60 also enables utilization of tower 10 in unusual conditions, such as under sloping garage ramps, stadium bents, highway ramps, and stair tread shoring.

The boltable braces 14 and 14' and adjustable bracing collar 60 enhance versatility of system 7 in the field. Such versatility is advantageous because, for instance, on thin slabs the load is so light that wider frames and longer braces gather more load, thus have fewer legs to rent, handle and re-shore, and re-handle. With wood bracing the brace length can be cut to fit the leg spacing needed to optimize load and/or as required the fit the building shape. However, the caps also provide the base for threaded studs to bolt on existing steel angles or spanked tube X-Bracing that is common to other types and brands of handset shoring.

Thus, the boltable nature of system 7 allows field adjustable frame width, leg height, ledger height, and brace spacing, which means the shore load capacity can be increased under a thick slab in one area yet decreased under a thin slab area for the most economical leg spacing and capacity.

The bracing anchor studs 23*a*, 23*b*, 24*a* and 24*b* also allow extra LVL planks to be bolted on so as to make a horizontal structure between two posts for supporting concrete beams, drop heads, column capitals, or work platforms, as may be required.

As mentioned, the unique top and bottom steel end caps 23 and 24 provide the bearing surface for the screw jacks, couplers, or U-heads, while also helping ensure alignment of their shanks. For instance, as shown in FIG. 4, the lower end cap 24 serves to provide a bearing surface for base jack 25 (which is a screw jack), and the upper end cap 23 serves to provide a bearing surface for U-head support 26.

Referring to FIGS. 1 and 6, the base jack 25 is a screw jack provided with a base plate 25*b* for resting on support surface 110. Jack 25 is also provided with a threaded shank 25*a* (extending perpendicular from plate 25*b*) and a threaded collar 25*c*. Threaded collar 25*c* bears upwardly against end plate 42' of lower end cap 24. Threaded collar 25*c* is then turned by lever arm 25*d* to adjust its height above surface 110 and, consequently, vary the height of the leg 20. Normally, the support surface 110 is either the floor of the building being constructed or else the last previously poured floor. The exposed lower end 9 of post 22 is bored (even on job-site) to a diameter which fits the shank 25*a* of base track 25 for receiving the same. Hence, base jack 25 can be substituted with alternative screw jacks or the like having differently sized shanks by merely drilling a different sized hole 58 in the lower exposed end 9 with the guidance of central pilot hole 58. Likewise, others shoring connections can be substituted for U-head 26 by simply boring an appropriately sized central bore in the exposed upper end 8 of post 22, also with the guidance of pilot hole 58. Such features are quite advantageous since they enable the separate components of shoring leg 20 to be interfaced with many of the various other systems already in use in the construction field as parts of rental inventories or contractor owned.

Figure 5:
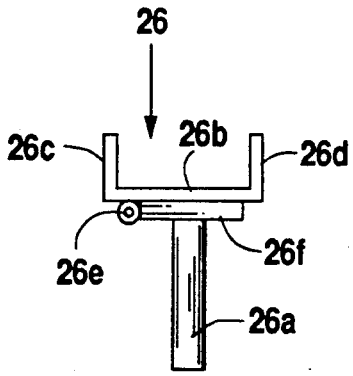
FIG. 5 shows a detailed view of U-head 26 of leg 20.

U-head 26 is similar to conventional U-heads in that it includes a horizontally oriented supporting plate 26*b* marginally bounded on opposite sides with upright flanges 26*c* and 26*d*, all in combination with a central shank 26*a* extending from its lower surface for connection with post 22. U-head 26 is novel though in that the support plate 26*b* hinges relative to shank 26*a*. More particularly, referring to FIG. 5, shank 26*a* is formed integral with a cap 26*f* which, in turn, is hinged by means of a butt hinge 26*e* to the support plate 26*a*. With such structure, the legs 20 and 20' and 21 and 21' of shore frames 11 and 12, respectively, are able to be pivoted in the direction of arrows 120 and 120' once cross-bracing 14 and 14' has been removed from shore frames 11 and 12. Although shown to be pivotable in the same direction in FIG. 1, hinges 26*e* of frame 12 are positioned on the opposite side of shore frame 12 in an another alternative (now shown) such that each of shore frames 11 and 12 of tower 10 can fold inwardly, toward each other. In that alternative embodiment, the legs 20 and 21 of shore frame 11 are slightly offset relative to the legs 20' and 21' of shore frame 12 such that, upon folding inwardly, there is no interference between the distal (i.e. lower) end of leg 20 with the distal end of leg 20', and there is no interference with the distal end of leg 21 with the distal end of leg 21'. Rather, due to the slight offset, legs of the opposite shore frame nest side by side for easy stacking.

Thus, frames 11 and 12 are adapted to hingeably fold, leaving headers 16 and 16', beam forms 70, and stringers 25 all attached for transporting to the next pour site or the next floor level, as may be the case. The foldable feature of shoring tower 10 also enables deckform 90 to be anchored to the new slab 100 above while the shoring system 7 is stripped, moved, re-erected, and plumbed. Then, deck form 90 can follow along later having a ready place to land—without requiring re-handling. Tower 10, when folded in the above manner, can be easily stacked and rolled up ramps on dollies with few clearance problems. For high rise buildings where there are no ramps, the shoring tower 10 may be lifted by crane and landed where needed with the legs 20, 20', 21 and 21' unfolded and braced.

Figure 8:
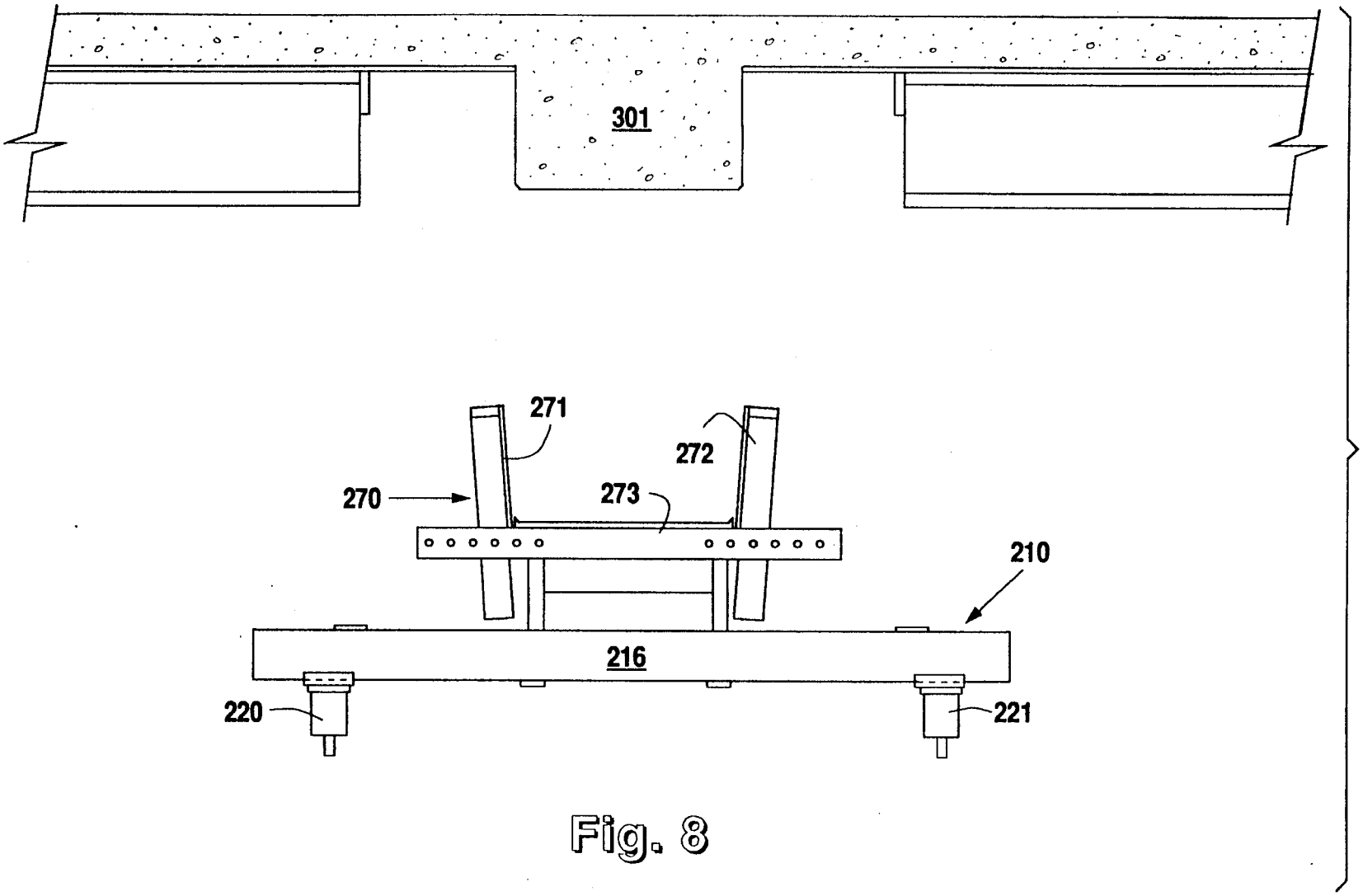
FIG. 8 shows the shoring frame 211 of the second embodiment with legs 220 and 221 folded thereunder and the adjustable beam form 270 stripped from concrete beam 301.

As shown in FIG. 4, a conventional beam form 70 is mounted by conventional means atop and spanning between headers 16 and 16'. Referring to FIGS. 7 and 8, though, a second pictured embodiment is shown which includes an adjustable beam form 270. The beam sides 271 and 272 of adjustable beam form 270 are releasably pivotable relative to soffit 273. The means for adjustable beam sides 271 and 272 is provided by a plurality of reinforced pivot connections 250–253 on soffit 273, which can be matched with similar reinforced pivot connections on studs 254–257, 274 and 275 for beam sides 271 and 272, respectively. Plyforms 280–282 are mounted to joists 274, 275 and soffit 273, respectively. With pivotable connection between joists 274 and 275 and soffit 273, the beam sides 271 and 272 can thus pivot (along with the adjoined plyforms 280 and 281) out of engagement with beam 301 once the beam 301 has been sufficiently cured. That done, the entire shoring tower 310, with beam form 270 tied thereto, can be broken down and moved to the next pour site or the next level. Supports 240 and 241 actually support soffit above the headers 216 of shoring tower 210. Supports 240 and 241 can be replaced as dimension requirements may change. Soffit 273 is originally connected to supports 240 and 241 which, in turn, are mounted to headers 216 by means of conventional tie-downs 268 and 269. The beam sides 271 and 272 are locked in the perpendicular relationship with soffit 273 by braces 251 and 252 during the pour of beam 301. Shoring tower 210 is substantially the same as shoring tower 10 which has been described in conjunction with FIGS. 1–6. This configuration also provides adjustable draft for the beam side taper, gives stripping relief, and allows the beam side to pivot down into a horizontal position flush with the beam soffit 273, making a level platform for stacking other legs, plywood, fillers, or other accessories onto the dolly for moving to the next level. FIG. 8 shows the shoring tower 210 with legs 220 and 221 folded thereunder and beam sides 271 and 272 hinged outwardly. This demonstrates the benefits provided during stripping of beam form 270 from beam 301 after curing.

Though described in terms of the foregoing preferred embodiments, such embodiments are merely exemplary of the present invention. In addition, many other alternatives, variations, adaptations, modifications, equivalents and substitutions are anticipated and intended. For instance, although the shoring system 7 is shown having beam form 70 (and adjustable beam form 270 in the second embodiment) mounted thereto, shoring system 7 might readily be employed simply for supporting a deck form alone. Likewise, the structure of the individual shore legs 20, 20', 21 and 21' could be employed in a wide variety of other types of shoring system where significant axial loads are encountered. Other bracing configuration would also serve the same purposes as those disclosed, and many other variations will be readily apparent to those of ordinary skill in this art. Accordingly, nothing herein limits the scope of the present invention, which is defined instead by the claims appended hereto, construed as broadly as possible to cover the full scope of the invention.

I claim the following:

1. An improved shoring leg, comprising:

a timber post having a longitudinally-oriented central hole there through, said post being cut to a desired length for its intended use, and said post having first and second opposing longitudinal ends;

a first end cap fit snugly on the first end of said post, said first end cap including an end plate having a central hole there through for receiving the shank of a screw jack, said central hole being oriented concentric with the pilot hole of said post to enable boring of a bore sized to receive;

a screw jack operably mounted to said post at said first end cap for enabling employment of the shoring leg in a shoring system, the shank of said screw jack fitting within a similarly-sized bore in the first end of said post which is bored with the guidance of said pilot hole;

said post comprises first and second mating members which are laminated together on mating faces, at least one of said mating members being provided with a groove along its length in a position such that, upon mating of said mating members, said groove defines the pilot hole through said post.

2. The improved shoring leg of claim 1, wherein said first and second mating members are composed of laminated veneer lumber.

3. The improved shoring leg of claim 1, wherein said first end cap is sized and shaped relative to the size and shape of said first end of said post such that triaxial compression is induced in said first end of said post when said first end cap is operatively fit thereon.

4. The improved shoring leg of claim 3, wherein the inner surface of sidewalls of said first end cap are tapered toward an end plate of said first end cap.

5. An improved shoring leg, comprising:

a laminated veneer lumber post having a longitudinally-oriented central pilot hole therethrough, said post comprising first and second mating members having mating surfaces which are laminated together, at least one of said mating members being provided with a groove along its length in a position such that, upon mating of said mating members, said groove defines the pilot hole centrally through said post, said post being cut to a desired length for its intended use, and said post having first and second opposing longitudinal ends;

a first end cap fit snugly on the first end of said post, said first end cap including an end plate having a central hole therethrough for receiving the shank of a screw jack, said central hole being oriented concentric with the pilot hole of said post to enable boring of a bore sized to receive the shank of a shoring connection therein;

a screw jack operably mounted to said post at said first end cap for enabling employment of the shoring leg in a shoring system, the shank of said screw jack fitting within a similarly-sized bore in the first end of said post which is bored with the guidance of said pilot hole;

a second end cap fit snuggly on the second end of said post, said second end cap including an end plate having a central hole therethrough for receiving the shank of a U-head connection, said hole being oriented concentric with the pilot hole of said post;

each of said first and second end caps being fit on the respective first and second ends of said post in a manner such that triaxial compression is induced in the first and second ends thereof;

a screw jack operably mounted to said post at said first end cap for enabling employment of the shoring leg in a shoring system, the shank of said screw jack being positioned within a similarly-sized hole in said post, which hole is bored with the guidance of said pilot hole;

a U-head operably mounted to said post at said second end cap for enabling employment of the shoring leg in a shoring system, the shank of said U-head being positioned within a similarly-sized end bore in said post, which end bore is bored with the guidance of said pilot hole.

6. An improved shoring tower, comprising:

a first shore frame comprising a first leg and a second leg with bracing therebetween, each of said first and second legs comprising:

a laminated veneer lumber post having a longitudinally-oriented central pilot hole therethrough, said post comprising first and second mating members having mating surfaces which are laminated together, at least one of said mating members being provided with a groove along its length in a position such that, upon mating of said mating members, said groove defines the pilot hole through said post, said post being cut to a desired length for its intended use, and said post having first and second opposing longitudinal ends;

a first end cap fit snugly on the first end of said post, said first end cap including an end plate having a central hole therethrough for receiving the shank of a screw jack, said central hole being oriented concentric with the pilot hole of said post to enable boring of a bore sized to receive the shank of a shoring connection therein;

a screw jack operably mounted to said post at said first end cap for enabling employment of the shoring leg in a shoring system, the shank of said screw jack fitting within a similarly-sized bore in the first end of said post which is bored with the guidance of said pilot hole;

a second end cap fit snuggly on the second end of said post, said second end cap including an end plate having a central hole therethrough for receiving the shank of a U-head connection, said hole being oriented concentric with the pilot hole of said post;

each of said first and second end caps being fit on the respective first and second ends of said post in a manner such that triaxial compression is induced in the first and second ends thereof;

a screw jack operably mounted to said post at said first end cap for enabling employment of the shoring leg in a shoring system, the shank of said screw jack being positioned within a similarly-sized hole in said post, which hole is bored with the guidance of said pilot hole; and a U-head operably mounted to said post at said second end cap for enabling employment of the shoring leg in a shoring system, the shank of said U-head being positioned within a similarly-sized end bore in said post, which end bore is bored with the guidance of said pilot hole;

a second shore leg frame structurally similar to said first shore frame;

first and second cross-braces connected to and between said first shore frame and said second shore frame for maintaining said first shore frame parallel to said second shore frame;

each of said first and second shore frames including a header tied atop the first and second shore legs and said third and fourth shore legs thereof.

7. The improved shoring tower of claim 6, wherein the header of each of said first and second shore frames is hingeably connected to each of the first and second shore legs atop which the respective header is tied.

8. The improved shoring tower of claim 7, wherein:

the header of said first shore frame is connected to the header of said second shore frame by a member spanning the distance therebetween;

the legs of said first shore frame are offset relative to the legs of said second shore frame; and the leg of said first frame hinges toward the legs of said second frame and the legs of said second frame hinge toward the legs of said first frame when being pivoted from vertical orientations, in a manner such that the legs of said first frame and said second frame nest alongside one another upon folding, thereby minimizing the stacked height of the shoring tower when the legs thereof are folded.

9. The improved shoring tower of claim 8, further comprising:

a beam frame rigidly connected atop said headers and spanning the distance therebetween;

said beam frame having beam sides which are pivotable relative to a beam soffit of said beam frame to enable stacking of said shoring tower.

10. An improved shoring leg, comprising:

a timber post having a longitudinally-oriented central hole there through, said post being cut to a desired length for its intended use, and said post having first and second opposing longitudinal ends;

a first end cap snugly on the first end of said post, said first end cap including an end plate having a central hole there through for receiving the shank of a screw jack, said central hole being oriented concentric with the pilot hole of said post to enable boring of a bore sized to receive;

a screw jack operably mounted to said post at said first end cap for enabling employment of the shoring leg in a shoring system, the shank of said screw jack fitting within a similarly-sized bore in the first end of said post which is bored with the guidance of said pilot hole;

an adjustable bracing collar slidably engaged with said post in a sleeve-like manner such that the position of said collar is adjustable between limits defined by the first end cap and the second end cap.

11. The improved shoring leg of claim 10, wherein said first end cap is sized and shaped relative to the size and shape of said first end of said post such that triaxial compression is induced in said first end of said post when said first end cap is operatively fit thereon.

12. The improved shoring leg of claim 11, wherein the inner surface of sidewalls of said first end cap are tapered toward an end plate of said first end cap.

13. An improved shoring leg, comprising:

a timber post having a longitudinally-oriented central hole there through, said post being cut to a desired length for its intended use, and said post having first and second opposing longitudinal ends;

a first end cap fit snugly on the first end of said post, said first end cap including an end plate having a central hole there through for receiving the shank of a screw jack, said central hole being oriented concentric with the pilot hole of said post to enable boring of a bore sized to receive;

a screw jack operably mounted to said post at said first end cap for enabling employment of the shoring leg in a shoring system, the shank of said screw jack fitting within a similarly-sized bore in the first end of said post which is bored with the guidance of said pilot hole;

said first end cap includes an end plate and sidewalls, the sidewalls being integrally joined to said end plate, and said first end cap further comprising a plurality of threaded nuts and studs rigidly connected to outer surfaces of said first end cap in orientations such that the central axes of said nuts and studs are radially oriented relative to the longitudinal axis of said post.

* * * * *